United States Patent [19]

Wollmann

[11] Patent Number: 4,526,534

[45] Date of Patent: Jul. 2, 1985

[54] CANTILEVER DIFFUSION TUBE APPARATUS AND METHOD

[75] Inventor: Andrew F. Wollmann, Chandler, Ariz.

[73] Assignee: Quartz Engineering & Materials, Inc., Tempe, Ariz.

[21] Appl. No.: 598,224

[22] Filed: Apr. 9, 1984

Related U.S. Application Data

[62] Division of Ser. No. 499,915, Jun. 1, 1983, Pat. No. 4,459,104.

[51] Int. Cl.[3] ..... F27D 3/00; F27D 7/00; F27B 9/04; F27B 3/22

[52] U.S. Cl. ..... 432/11; 432/19; 432/23; 432/26

[58] Field of Search ..... 432/11, 19, 23, 26

[56] References Cited

U.S. PATENT DOCUMENTS 4,351,805 9/1982 Reisman et al. ..... 432/205

4,412,812 11/1983 Sadowski et al. ..... 432/11

*Primary Examiner*—John J. Camby

*Attorney, Agent, or Firm*—Cahill, Sutton & Thomas

[57] ABSTRACT

A cantilever diffusion tube apparatus includes a quartz cantilever tube having a support end clamped to a laterally movable carriage mechanism and an outer end portion containing a plurality of spaced semiconductor wafers. The cantilever tube is coaxially aligned with a diffusion tube of a diffusion furnace. The support end of the cantilever tube is sealed by a door plate through which a gas tube extends. The wafers are loaded into the cantilever tube through a window opening. The carriage then moves the cantilever tube and wafers therein into the diffusion tube. Reactant gases are caused to flow into the cantilever tube, between the heated wafers therein, and out of the cantilever tube. Then purging gas is caused to flow through the cantilever tube and wafers therein. Withdrawal of the cantilever tube from the diffusion tube is then performed as the purging gas flow continues, avoiding excessive thermal shock, premature exposure of wafers to ambient oxygen and exposure of the wafers to air containing defect-causing particles. The cantilever tube, when contaminated after a number of runs, is easily exchanged for a clean one, avoiding the need for frequent cleaning of the diffusion tube.

14 Claims, 19 Drawing Figures

CANTILEVER DIFFUSION TUBE APPARATUS AND METHOD

This is a division of application Ser. No. 06/499,915 filed June 1, 1983, now U.S. Pat. No. 4,459,104.

BACKGROUND OF THE INVENTION

The invention relates to apparatus and methods for loading quartz boats of semiconductor wafers into diffusion furnaces for processing at elevated temperatures, without generating excessive numbers of defect-causing particulates, and relates more particularly to cantilever apparatus for moving diffusion boats and wafers supported thereby into diffusion furnaces without quartz-to-quartz abrasion or contact.

A variety of semiconductor processing operations are commonly performed in diffusion furnaces, which in a modern semiconductor wafer fabrication facility frequently include two "stacks" of diffusion furnaces placed side by side. Each stack typically includes four horizontal quartz "diffusion tubes", each approximately eight feet long, positioned each above the other in a "diffusion furnace". The two stacks are positioned back to back, each being accessible from an opposite side. At one end of each stack is a "source cabinet" in which connections to controlled sources of various reactant gases can be made to the "pigtail" end of each diffusion tube. The opposite "mouth" end of each diffusion tube extends into a "scavenge box" into which used reactant gases are exhausted and conducted to a "scrubber" that performs the function of burning off certain components of the exhausted gases. A "load station" for each diffusion tube is connected to the loaded end of each diffusion furnace.

Those skilled in the art will realize that the foregoing arrangement of back to back stacks is necessary to minimize the amount of floor space required because it is known that an ultra-pure environment must be maintained in a modern wafer fabrication facility to avoid, to the greatest extent possible, the existence of particulates, even those in the range from 0.5 microns to 4 or 5 microns in diameter, in the ambient air. This is because it is well known that particles of this size can cause defects in the integrated circuits being manufactured in the wafers. The resulting decrease in wafer yield (and hence the increase in fabrication cost per integrated circuit) increases with the density of such particulates in the wafer fabrication environment. As state of the art of integrated circuits proceeds toward minimum line widths, and line spacings are reduced toward one micron, the minimum size of a typical particle that will cause a catastrophic defect in an integrated circuit becomes smaller and smaller. Tremendous amounts of capital have been invested by the semiconductor industry over the past decade or so to improve purity of the air and environment which is required for high yield wafer processing. Floor space in such a modern wafer fabrication facility is extremely expensive.

The various wafer processing operations mentioned above typically include semiconductor diffusion operations at high temperatures of over 1,000° C., and also somewhat lower temperature processes, including thermal oxidation and LPCVD (low pressure chemical vapor deposition) processes such as deposition of silicon nitride or polycrystalline silicon on semiconductor wafers.

In order to perform the foregoing processing operations, it is necessary to load quartz diffusion boats, each holding typically 50 to 75 four inch or five inch partially processed semiconductor wafers, into the open end of the quartz diffusion tube of a diffusion furnace. Often this has been accomplished using "paddles" which are quartz platforms with quartz wheels that roll along the lower inner surface of the horizontal diffusion tube to convey the wafers into a "hot zone" of the diffusion furnace, whereat the temperature of the wafers is elevated and stabilized at the desired level for the desired oxidation, diffusion, or a chemical vapor deposition process. Quartz-to-quartz abrasion occurs in such loading systems, generating quartz particles that are commonly referred to as "quartz dust" and are capable of causing defects in the integrated circuits if they settle on the surface of the semiconductor wafers. Not only do such defects reduce the yield by causing some of the integrated circuits to fail function tests, but they also sometimes produce latent defects which allow the integrated circuits to pass functional tests and hence, are sold, but lower the longer term reliability of these integrated circuits.

For LPCVD processes, the silicon nitride or polycrystalline silicon layers which are deposited upon the exposed surfaces of the semiconductor wafers are also deposited on the inner surface of the diffusion tubes. The wheels of the paddle roll on the deposited material on the inner surface of the diffusion tube, causing pieces of the deposited material to break off, thereby generating large numbers of defect-causing particles, some of which settle on and adhere to the semiconductor wafer surfaces. Furthermore, both silicon nitride and polycrystalline silicon layers on quartz have greatly different coefficients of thermal expansion than quartz, causing great stresses at the quartz interface as the diffusion tube temperature is decreased. These stresses can cause breaking off of defect-producing silicon nitride or polycrystalline silicon particles which may settle on and adhere to a wafer surface. Furthermore, the interface stresses also cause surface fractures in quartz, which fractures can spread in the quartz, causing premature breakage.

The damage that can be caused by particles produced by the foregoing wafer loading and unloading processes are severe enough that "cantilever" loading systems have been developed and marketed by several manufacturers, wherein two parallel quartz covered cantilevered metal rods are supported at one end from a carriage or "driver" mechanism and are movable into and out of a diffusion tube while supporting one or two boat loads of wafers. The two quartz rods extend from a "door" plate which forms a seal with the flanges of the mouth of the diffusion tube, preventing escape of reactant gases. These cantilever devices, when operating properly, substantially eliminate quartz-to-quartz abrasion during the wafer loading and unloading operations, resulting in extremely low densities of defect-producing particles within the diffusion tube. However, this advantage has not been attained without introducing other problems that have not yet been solved, nor has the use of such cantilever devices solved some other long-standing problems that decrease yields and increase costs in the wafer fabrication art.

As to problems particularly associated with the above-mentioned prior art cantilever systems, those systems are less than totally satisfactory at the high temperatures that are required for semiconductor diffusion operations because the cantilever rods tend to sag or droop at such high temperatures. Since the length of the quartz rods of such a device is approximately five feet and the weight of each of the wafer-loaded boats is approximately four or five pounds, the maximum number of such loaded boats that can be used on the prior cantilever devices is usually two. This represents a considerable reduction in the number of wafers that can be carried by the above-mentioned paddle loading systems, which typically can carry four or more boat loads of as many as 75 four or five inch wafers. Therefore, the use of the prior cantilever loading devices reduces the throughput rate of a diffusion furnace, and the cost of this reduction must be weighed against the expected increase in yield resulting from the lower density of defect-causing particules generated within the diffusion tube by the devices as opposed to conventional loading and unloading processes using the above "paddles".

The aforementioned "sag" also dictates the processing of somewhat smaller wafer sizes in a given size diffusion tube to allow for wafer-to-diffusion tube tolerances that must be allowed because of the sag.

The inherent flexibility in such cantilevered rod systems sometimes allows physical oscillation to occur in the system during operation of the carriage transport mechanism. This phenomenon further contributes to the tolerance problem and therefore further reduces the maximum water size that can be processed in the system.

Even with only two boat loads of wafers supported on its free end, the forces exerted on the prior art cantilever loading device rods are far too great for solid quartz rods to support, so is has been necessary to use hollow quartz rods inside of which much stronger "center rods" of alumina, graphite, or silicon carbide are inserted. Typically, the rear ends of the center rods are clamped by means of a clamping mechanism to a carriage that rides on a linear bearing, such as a Thompson bearing. The portions of such center rods that extend through the "door plate" into the diffusion tube are covered by the hollow quartz rods on which the wafer-loaded diffusion boats rest. Unfortunately, it is not feasible to obtain truly impurity-free alumina graphite or silicon carbide center rods. The rods actually used are believed to contain fast-diffusing contaminants, such as heavy metals and sodium, which have deleterious effects on certain critical semiconductor parameters, such as surface-state charge $Q_{SS}$ of the wafers, causing reduced wafer yields.

One of the most severe problems with the state of the art cantilever systems is that when the wafers supported thereby are withdrawn from the furnace, the wafers too rapidly encounter ambient atmospheric oxygen as the wafers are moved out of the diffusion tube into the loading station. If this happens before the wafers have had a chance to cool to a low enough temperature (typically about 600° C.), the oxygen will cause unacceptable shifts in $Q_{SS}$, unless vast quantities of purging gas (typically nitrogen) are used. Usually, if a conventional paddle system is used, an extension tube sometimes referred to as a "white elephant" is attached to the open mouth of the diffusion tube, and the paddle and wafers thereon are withdrawn from the hot zone of the diffusion tube into the "white elephant" while the purging gas continues to flow, preventing exposure of the wafers to atmospheric oxygen until temperature of the wafers falls below roughly 600° C. Unacceptable $Q_{SS}$ shifts are avoided without use of excessive amounts of purging gas.

The prior art cantilever loading systems, however, require thousands of times more nitrogen gas during purging than the paddle type loading/unloading systems, and also require much slower withdrawal rates. The nitrogen gas is quite expensive. The slow withdrawal rates add to the length of time required for the process, and consequently, reduce the throughput rate of the diffusion stations; yet the slow withdrawal is necessary to avoid both $Q_{SS}$ shifts and unacceptable wafer warpage, the latter of which may cause subsequent masking and photoresist problems and may also cause slippage in the semiconductor lattice structure. Such slippage can propagate through the wafer during subsequent high temperature processing steps and generate semiconductor junction defects and thus also cause circuit inoperability.

Another severe shortcoming of the prior cantilever loading systems is that the alumina center rods mentioned above have relatively large area cross sections and present very high thermal mass beneath the wafers. This situation results in non-uniform flow of the reactant gases (which is known to be undesirable) and more importantly, causes significant gradients in the temperature inside the diffusion tube across the diameter thereof. This results in non-uniformity of the process being carried out, whether it be a diffusion process, chemical vapor deposition process, or oxidation process. For example, in thermal oxidation processes, there is typically a variation of 50 angstroms per thousand across the wafers from top to bottom. The above mentioned non-uniformity is undesirable and can cause yield-reducing variations in circuit performance from top to bottom of wafer.

Another problem with the prior cantilever systems is that the wafers are withdrawn from the diffusion tube from the ultra-pure, low defect-causing particle density environment within the diffusion tube into the loading station, which ordinarily is in a non-laminar air flow environment having a considerable density of defect-causing particulates which to some extent negates the desirable low particulate density achieved within the diffusion tube. Due to the structure of typical loading stations and the need to stack them back to back, modifications to provide laminar air flow and the resulting desired low particulate density in the loading station are usually prohibitively costly.

Another problem of prior art cantilever loading systems that has been alluded to above is the reduced number of wafers per run (typically 100 wafers) that can be accomplished with state-of-the-art cantilever loading systems compared to the number of wafers (typically several hundred) for prior paddle systems.

Another problem of prior art cantilever loading systems is that when the hollow quartz tubes through which the alumina rods extend are initially heated to a high temperature, the quartz material sags, and later when the temperature of the rods and quartz is reduced (during a subsequent withdrawal step) internal stresses are generated in the quartz. This stress adds to stresses produced later due to the weight of one or two boat loads of wafers that are placed on the quartz rods. Occasionally, the prior cantilever loading systems fail due to breakage of the center rods or quartz, causing damage to or breakage of the wafers supported thereon. This can be extremely costly, due to the high value of the wafers themselves.

Another very severe shortcoming of the prior cantilever systems is that they require a large amount of labor and "down time" of the diffusion furnace to replace them. The prior cantilever rods need to be replaced fairly frequently, due to build up of contaminants on them or breakage or fracture of the quartz rods. Typically, three to four hours are needed to change the quartz rods, due to the need to "ramp down" (decrease) the temperature of the diffusion tube to allow working in the vicinity, and also due to the need to achieve extremely precise alignment and clamping of the alumina rods to the carriage mechanism so that stresses on the hollow quartz rods and quartz "bridges" interconnecting the rods are avoided (as breakage otherwise would be likely to occur).

Another problem with the prior cantilever systems is that due to the large cross sectional area of the rods that support the wafer-loaded quartz diffusion boats, the maximum size of wafers that can be used in a diffusion furnace of a particular diameter is not as great as would otherwise be the case. Since there is a present trend in the industry to increase the size of wafers processed from five inches to six inches, it will be necessary, if prior cantilever devices are to be used for wafer fabricators, to use larger diameter diffusion tubes that are much more expensive, and which is some cases can only be stacked three deep rather than four deep at each diffusion station. This will increase the amount of expensive floor space needed in the wafer fabrication area.

Another problem with some of the state of the art cantilever diffusion systems is that the carriage and the alumina rods conduct too much heat to the carriage mechanism. This has caused vaporization of grease in the bearing mechanism and when the wafers are withdrawn, some of this vaporized grease has been redeposited in the form of carbon films on the semiconductor wafer surface. This can cause reductions in wafer yield.

There are several long-standing problems that have been common to all prior loading systems and diffusion systems. One has been the need to frequently clean diffusion tubes, which become contaminated every 10 to 15 wafer processing operations or runs. In order to clean quartz diffusion tubes, it is necessary to ramp the temperature gradually down to a temperature at which the tube can be either removed for cleaning or cleaned in situ. The ramping rate is typically only 4° C. per minute, so the ramping down process can take four to ten hours, depending on its initial temperature. After the diffusion tube has been cleaned, which requires a considerable amount of labor and large amounts of expensive ultrapure chemicals (which then must be disposed of at significant expense), the diffusion tube must then be "ramped up" to the proper operating temperature. Again, this can take many hours. The result of the need to frequently clean diffusion tubes is that for as much as one-third to one-half of its total lifetime, the diffusion tube is not being used for wafer processing. Furthermore, in diffusion tubes in which LPCVD processes are carried out, the above mentioned damage in the form of surface fractures to the quartz (due to the above mentioned large differences in coefficients of thermal expansion of silicon nitride and polycrystalline silicon compared to quartz) shortens the lives of expensive quartz components.

Quartz "liners" have been used in the past. These are cylindrical tubes that are used to line the diffusion tubes. They can be installed more easily than the diffusion tubes, and can be removed more easily for cleaning (after they become contaminated by 10 to 15 runs) than the diffusion tubes. However, these liners are generally subject to all of the shortcomings mentioned above, and also to the one mentioned next.

Another long standing problem in the LPCVD silicon nitride deposition process is sometimes referred to as "streaking". This occurs when wafers are withdrawn from a silicon nitride deposition process. It is thought that ammonium chloride that sublimates on the internal surfaces of the colder portions of the diffusion tube (or liner) later vaporizes when the hot wafers are withdrawn past the sublimated ammonium chloride at the mouth of the diffusion tube, and then is redeposited in the form of streaks or haze on the surface of the wafer as it is withdrawn. Although it is not known precisely what effect this has on wafer yield, it is suspected that it probably decreases the effectiveness of subsequent masking and photoresist operations and decreases overall yield.

One technique that has been used in the past, and is believed to be still in use in experimental semiconductor processing is the use of sealed quartz ampules in which wafers are sealed with reactant gases before the ampules are pushed into a diffusion furnace. This technique can produce a very pure, particulate-free atmosphere within the ampules during the diffusion process by avoiding quartz-to-quartz abrasion that generates defect-causing particulates. However, the ampules must be broken and thus destroyed after removal and cooling of the ampules to recover the wafers. Furthermore, particulates ordinarily would be generated when the ampule is broken. This would necessitate careful subsequent cleaning of the wafers to avoid the resulting particles from causing defects. This approach clearly is not presently suitable for high volume, high yield wafer production processes.

OBJECTS OF THE INVENTION

It is an object of the invention to provide a diffusion tube apparatus and method for avoiding defects in semiconductor wafers due to minute particles including particules caused by abrasion or friction in a diffusion tube.

It is another object of the invention to provide a diffusion tube apparatus and method for avoiding diffusion of impurities associated with prior cantilever wafer loading systems, particularly ones with alumina, graphite, or silicon carbide support rods therein.

It is another object of the invention to provide a diffusion tube loading apparatus and method that avoid sag which occurs due to weakening of quartz and metal materials at high temperatures.

It is another object of the invention to provide a diffusion tube loading apparatus and method that avoid the need for high purging gas flow rates required by some prior cantilever wafer loading systems during unloading of wafers from a diffusion tube.

It is another object of the invention to provide a diffusion tube loading apparatus and method which avoid unloading wafers into a loading station wherein the air carries particles capable of causing defects in the wafers.

It is another object of the invention to provide a diffusion tube loading apparatus and method that avoid need for frequent cleaning of diffusion tubes and also avoid the need for ramping up and down of diffusion tube furnace temperature before and after cleaning of diffusion tubes.

It is another object of the invention to provide a cantilever diffusion tube loading apparatus and method that achieve more rapid wafer loading and unloading rates, without causing unacceptable wafer warpage and/or $Q_{SS}$ shifts than can be achieved with certain prior cantilever loading apparatus.

It is another object of the invention to provide a diffusion tube loading apparatus and method and avoid or reduce nonuniformities in oxidation rates and/or diffusion rates and/or LPCVD deposition rates across wafers in a diffusion furnace.

It is another object of the invention to provide a diffusion tube loading apparatus which is easily installed and precisely aligned with a diffusion tube in a diffusion furnace.

It is another object of the invention to provide a cantilever diffusion tube loading apparatus and method that allow a larger number of maximum sized wafers to be loaded into diffusion tube without incurring the risk of excessive sag or cantilever breakage that occurs in certain prior cantilever loading systems.

It is another object of the invention to provide a diffusion tube loading apparatus and method that avoid "streaking" or "haze" associated with withdrawal of hot wafers from a diffusion tube through a region in the diffusion tube wherein ammonium chloride or other impurity has sublimated near the mouth of the diffusion tube.

It is another object of the invention to provide a cantilever diffusion tube loading apparatus and method that avoid standing wave oscillations in the cantilever apparatus.

It is another object of the invention to provide a diffusion tube loading apparatus and method that tend to maintain a "diffusion tube environment" as wafers are withdrawn from a diffusion tube.

SUMMARY OF THE INVENTION

Briefly described, and in accordance with one embodiment thereof, the invention provides a diffusion tube apparatus and method including an inner tube, preferably of quartz, silicon carbide, or polycrystalline silicon, carrying a load of semiconductor wafers wherein the inner tube carrying the wafers is slowly inserted into an open end of a quartz diffusion tube in a conventional diffusion furnace, so that the wafers are conveyed into the "hot zone" of the furnace and the open end of the diffusion tube becomes sealed with respect to the inner tube and the proximal end of the inner tube is also sealed except for a gas conducting passage which allows flow of purging or reactant gas through the inner tube, wherein the wafers in the inner tube are elevated by the furnace to a predetermined temperature and reactant gas is passed through the inner tube, between the wafers, and out of the inner tube for a predetermined amount of time, after which the reactant gas is exhausted from both tubes and replaced by a purging gas, wherein the inner tube and wafers therein are slowly withdrawn from the outer diffusion tube into a loading zone. The wafers then are removed directly from the inner tube.

In a described embodiment of the invention, the inner tube is a cantilever quartz tube having a mounting flange at its proximal end. The mounting flange is clamped to a "drive" mechanism that supports the cantilever tube in a horizontal position coaxially aligned with the diffusion tube of the furnace. The drive mechanism glides along a linear track to effectuate insertion and withdrawal of the cantilever tube and wafer-loaded boats therein into and out of the diffusion furnace. A generally rectangular, semi-cylindrical window opening is provided in a distal end portion of the cantilever tube, through which window opening quartz boats loaded with semiconductor wafers are loaded into the distal end portion of the cantilever tube. A close fitting quartz cover is disposed over the window opening before the cantilever tube and wafers therein are inserted into the diffusion tube to keep any particulates in the diffusion tube out of the cantilever tube and to prevent leaking of gases into or out of the cantilever tube through the window.

The distal end of the cantilever tube is entirely or partially open, depending upon the semiconductor process to be performed in the furnace. A stainless steel annular clamp ring clamps the inward face of the mounting flange to a stainless steel "door" plate through which a pair of gas tubes extend for allowing purging gas or reactant gas to flow through the cantilever tube. Another opening with an ultra-torr fitting therein is provided in the door plate to facilitate insertion of a thermocouple to allow temperature profiling of the interior of the cantilever tube in the hot zone of the furnace. The door plate has a pair of shoulder screws that are aligned with and received by a corresponding pair of vertical slots in an adjustable vertical support plate. The support plate is adjustable by means of a three-point support arrangement including an upper pivot ball connected to a "back plate" and a pair of lower adjustable thrust bearing supports to facilitate "aiming" of the cantilever tube to align it with the longitudinal axis of the diffusion tube. The back plate is attached to a thick, precision-made cylindrical stainless steel rod that slides in a linear bearing mechanism. The linear bearing is rigidly attached to a carriage that moves on a linear track to effectuate insertion and withdrawal of the cantilever tube.

In operation, a cantilever tube contaminated by use can be quickly disconnected from the support plate to allow cleaning of that cantilever tube while another identical but cleaned cantilever tube (with a clamping ring and a door plate already attached thereto) is being used to process wafers. Removal of the contaminated cantilever tube is accomplished by simply disconnecting flexible gas lines from the connectors attached to the two gas tubes extending through the door plate, and lifting the cantilever tube so the two shoulder screws slide out of the two vertical slots in the support plate. The clean cantilever tube then is attached to the support plate by simply aligning the shoulder screws of the door plate attached to the clean cantilever tube with the two vertical slots of the support plate and lowering the clean cantilever tube to slide the shoulder screws into those slots. The clean cantilever tube then will be properly aligned with the diffusion tube of the furnace. The gas tube couplers are quickly connected and a new load of wafers supported in a plurality of quartz boats is loaded in the clean cantilever tube, and a new cycle is begun within a few minutes after the last run of wafers is unloaded from the contaminated cantilever tube.

Thus, this apparatus obviates the need to clean the diffusion tube of the furnace every ten or so wafer runs, and also avoids the long cycles of ramping the furnace temperature down to allow removal and/or cleaning of a contaminated diffusion tube and also the time consumed by ramping up of furnace temperature after cleaning of the diffusion tube.

The foregoing embodiment of the invention is very well suited to low pressure chemical vapor deposition (LPCVD) processes and avoids many of the problems associated with abrasion that produces large numbers of defect-causing particulates in other wafer loading systems. The foregoing apparatus also avoids the use of excessive amounts of purging gas and very slow withdrawal or "pull" rates of the wafers from the furnace that are necessary to prevent "thermal shock" and $Q_{SS}$ shifts due to premature exposure of the hot wafers to atmospheric oxygen, in contrast to some prior cantilever loading systems.

In another described embodiment of the invention that is more suited to high temperature operations, such as thermal oxidation and diffusion, two quartz flanges, rather than only one, are provided on the proximal end of the cantilever tube. One of two flanges is at the mouth of the cantilever tube for clamping the door plate to the cantilever tube. The second flange is spaced from the mounting flange and abuts the mouth flange of the diffusion tube and causes sealing thereto. The spacing between these two flanges of the cantilever tube thermally isolates the mounting flange from the high temperatures of the portion of the cantilever tube that is within the diffusion furnace and thereby avoids overheating of the clamping and "drive" mechanism.

Purging gas and/or reactant gas can be input or exhausted from the diffusion tube either through the "pigtail" at the remote end of the diffusion tube (which pigtail usually extends into a source station where connections to reactant gas sources or purging gas sources can be conveniently made), or by means of a radial inlet hole through a flange clamped to the mouth of the diffusion tube. The exhaust gas bypass tube is provided within the cantilever tube to allow gas to flow from the diffusion tube around the sealing flange of the cantilever tube and back out of the cantilever tube on the other side of the sealing flange.

In another embodiment of the invention, wherein $POCl_3$ is the reactant gas, a "cold" tube extends through the diameter of the cantilever tube between the sealing flange and the clamping flange. Cold gas is passed through this tube. One-half of the length of the unsupported end portion cold gas tube is surrounded by a half length of tube that extends from the outer surface of the cantilever tube to approximately the center thereof. The resulting annular clearance between between those two tubes functions as an exhaust passage for $POCl_3$ gas. Some of the $POCl_3$ gas condenses on the cold tube and then drips from the lip of the outer half tube into a drip dish resting in the proximal end of the cantilever tube.

In another embodiment of the invention that is particularly suitable for very high temperature processes, a "wheelbarrow" like mechanism is provided on the distal end of the cantilever tube supporting a quartz wheel that is positioned slightly above the bottom of the cantilever tube during insertion thereof into the diffusion tube. The quartz wheel runs up onto a small step provided on the bottom of the diffusion tube just before the cantilever tube reaches its final position in the diffusion tube. The weight of the proximal end of the cantilever tube and load of wafers is thereby supported by the quartz wheel during the high temperature process and prevents sag of the distal end of the cantilever tube. In another embodiment of the invention, a second quartz wheel is provided to similarly rest on the bottom of the diffusion tube in order to support the midportion of the cantilever tube and to prevent sag thereat. In yet another described embodiment of the invention, the inner tube is not supported in cantilever fashion by the drive mechanism and instead the quartz front wheel mechanism rolls along the bottom of the diffusion tube during the entire insertion and withdrawal procedure.

The described embodiments of the invention provide a controlled ambient for the semiconductor wafers during withdrawal from the furnace without the need for using excessive amounts of purging gas, minimize or eliminate generation of defect-producing particles within the diffusion tube during the withdrawal and insertion operations, isolate wafers in the cantilever or inner tube from any defect-causing particles within the diffusion tube and also within the loading station, avoid streaking or haze caused by vapor deposition of ammonium chloride on the wafer surface during withdrawal from the diffusion tube after a nitride deposition process, allow utilization of larger diameter semiconductor wafers in a particular size of diffusion tube than is possible with prior cantilever loading systems, and avoid cantilever sag at high temperatures to much greater extent than prior cantilever loading systems.

DESCRIPTION OF THE INVENTION

Figures 1, 1A:
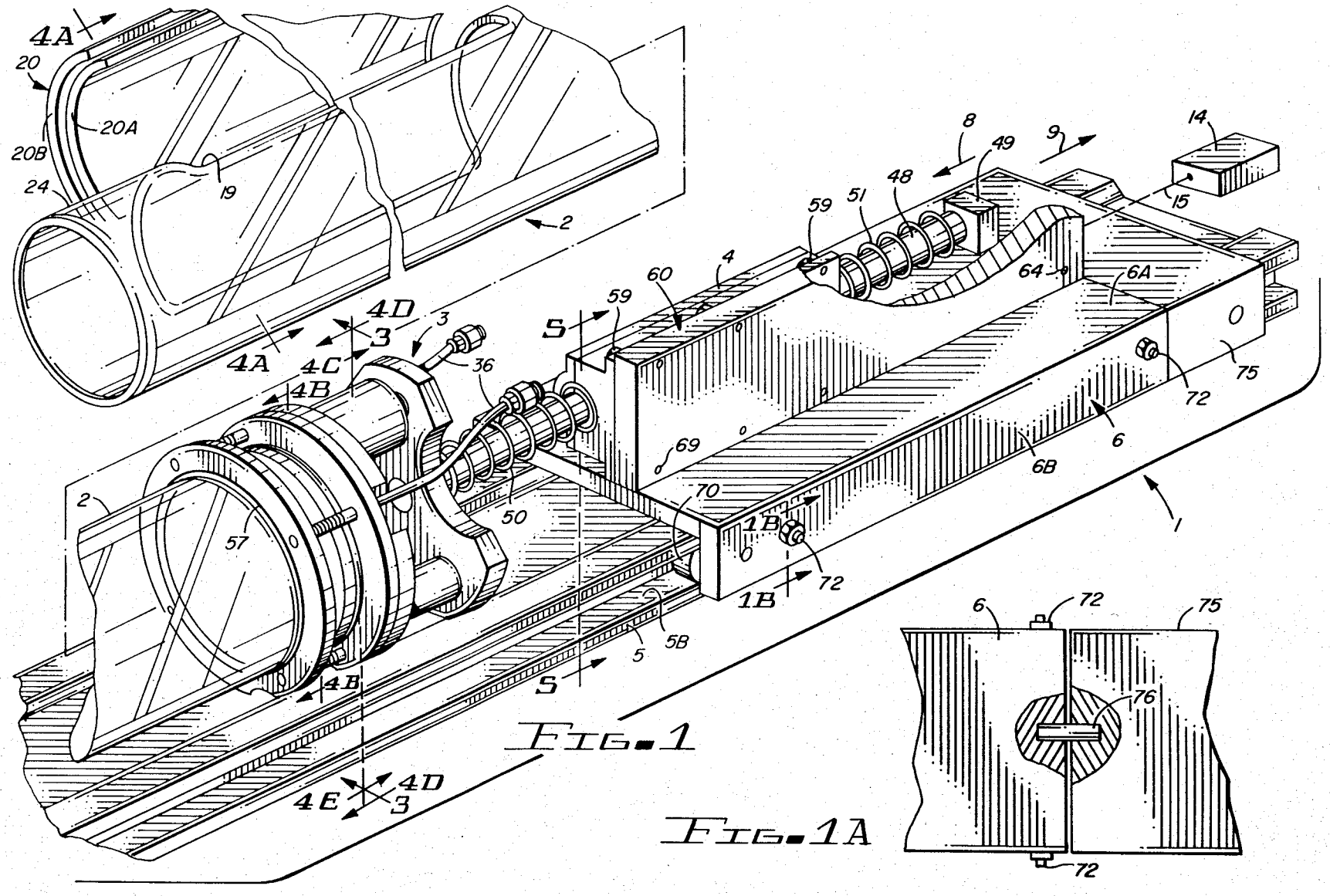
FIG. 1 is a partial cutaway perspective view illustrating the cantilever diffusion tube apparatus of the present invention.
FIG. 1A is a partial cutaway view illustrating a portion of the carriage assembly of FIG. 1.

Referring now to the drawings, and more particularly to FIGS. 1, 2A, 2B, 3, 4A–4D and 5, cantilever diffusion tube system 1 includes a quartz cantilever tube 2 supported in cantilever fashion by a clamping mechanism 3. Clamping mechanism 3 is supported by a linear bearing 4. Linear bearing 4 is rigidly attached to a carriage mechanism 6. Carriage mechanism 6 moves horizontally in the directions of arrows 8 or 9 on a precision rail 5. Four groups of wafers 11 (FIGS. 2A and 2B) are supported inside the distal end portion 2A of quartz cantilever tube 2. Each group of wafers is supported in a suitable quartz diffusion boat 12.

Figures 1B, 2A, 2B, 6A, 6B, 6C:
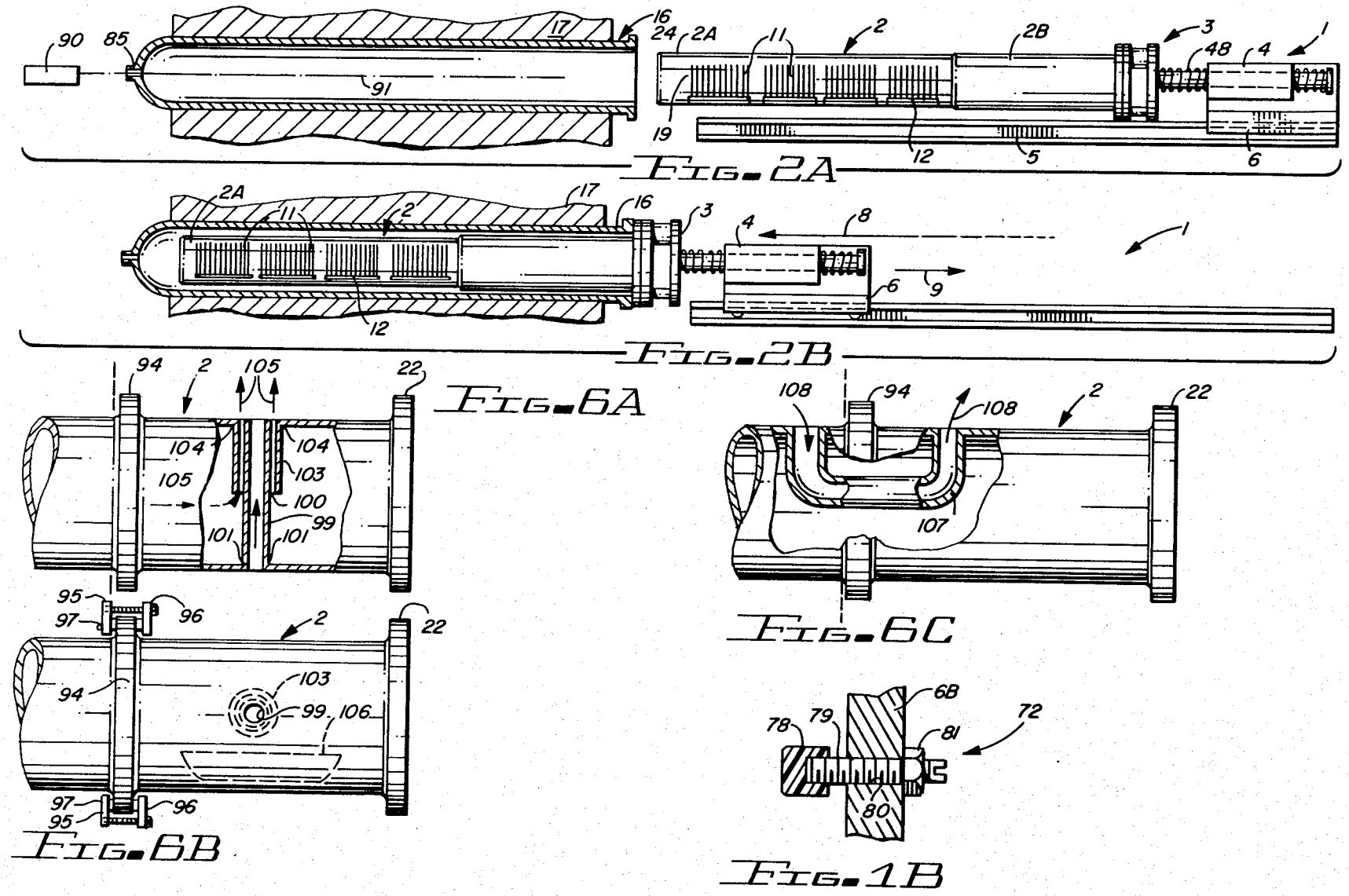
FIG. 1B is a partial section view of a Teflon bearing of the device of FIG. 1.
FIG. 2A is a partial cutaway elevation view of the apparatus of FIG. 1 prior to insertion in a diffusion tube of a diffusion furnace.
FIG. 2B is a cutaway partial cutaway elevation view of the apparatus shown in FIG. 2A after insertion of the cantilever tube of the present invention into the diffusion tube.
FIG. 6A is a partial cutaway top view of an alternate embodiment of the cantilever tube of the present invention.
FIG. 6B is an elevation view of the subject matter shown in FIG. 6A.
FIG. 6C is a partial elevation cutaway view of an alternate cantilever tube of the present invention.

Initially, cantilever tube 2 is supported above rail 5 as generally indicated in FIG. 2A. A motor-driven mechanism 14 (FIG. 1) is coupled by a suitable linkage 15 to carriage 6 and is programmed or otherwise actuated to cause carriage 6 and cantilever tube 2 to move from the position of FIG. 2A into the mouth opening of a conventional quartz diffusion tube 16, which is disposed in a conventional diffusion furnace 17. In accordance with the invention, cantilever tube 2 is supported inside diffusion tube 18 so that it is coaxially aligned therewith. Therefore, no abrasion occurs between diffusion tube 16 and cantilever tube 2 during insertion or withdrawal of cantilever tube 2, thereby avoiding the production of any defect-causing micron-sized particles which cause so much difficulty in the semiconductor wafer fabrication industry.

It should be appreciated that in FIGS. 2A and 2B, reference numeral 17 schematically illustrates the furnace 17 in which diffusion tube 16 is disposed. Those skilled in the art know that typical furnaces have a heated horizontal "canister" in which the diffusion tube lies and receives infrared radiation therefrom to create a "hot zone" in diffusion tube 16 and that to accomplish the oxidation, diffusion, or deposition process that is desired, the wafers must be properly positioned in the hot zone before the necessary reactant gases are caused to flow through the diffusion tube.

After the desired reactant gases have been caused to flow through cantilever tube 2 in a manner subsequently described, drive mechanism 14 withdraws cantilever tube 2 out ot diffusion tube 16 in the direction of arrow 9.

Figure 9:
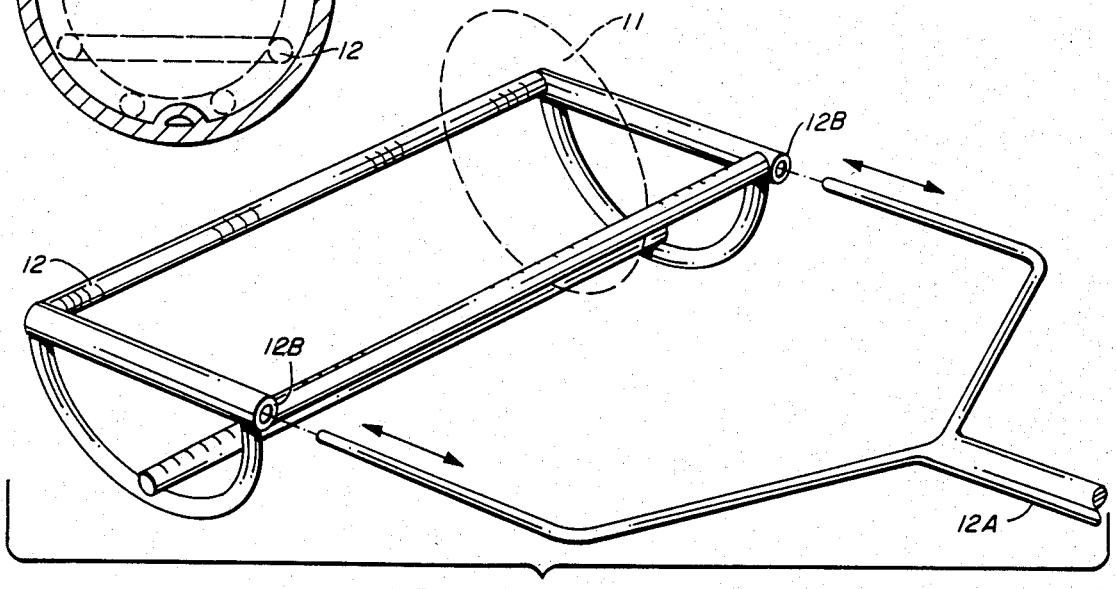
FIG. 9 is a perspective diagram illustrating a diffusion boat used in conjunction with the cantilever tube of the present invention and a fork tool used to lift the diffusion boat.

At this point, it will be helpful to describe in more detail the structure of cantilever tube 2, diffusion tube 16, clamping mechanism 3, and carriage 6. Referring particularly to FIGS. 1 and 2A, quartz diffusion tube 2 has a generally rectangular or semi-cylindrical window opening 19 which subtends an angle of 150 degrees in one side of distal end portion 2A of cantilever tube 2. The purpose of window 19 is to allow loading of quartz diffusion boats 12 with wafers 11 thereon by means of fork tool 12A, shown in FIG. 9. A boat 12 and the manner of lifting it with the fork 12A is also illustrated in FIG. 9.

Figure 4A:
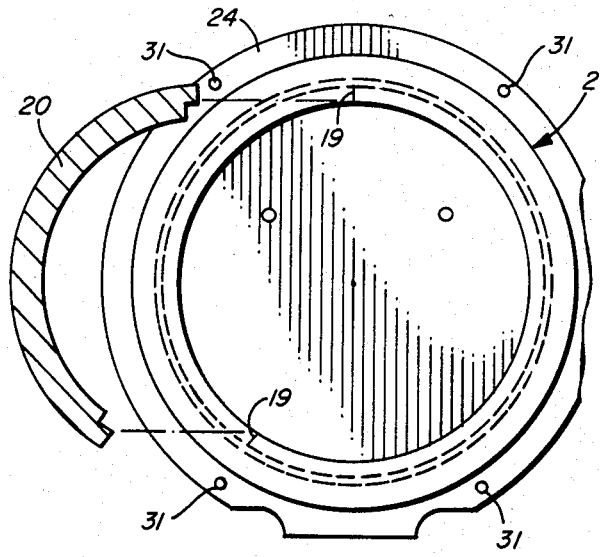
FIG. 4A is a section view taken along section line 4A—4A of FIG. 1.

Although not shown in FIG. 2A, a quartz cover that precisely fits and seals window opening 19 is shown in FIG. 1 and is designated by reference numeral 20. A cross section view of cover 20 is shown in FIG. 4A. Cover 20 has an inner portion 20A that fits precisely in window 19. Cover 20 also includes an outer "lip" portion 20B which functions as a support lip that rests precisely on the surface portion of cantilever tube 2 surrounding the periphery of window 19.

As best seen in FIG. 2A, cantilever tube 2 has a proximal end portion 2B having a thicker wall than distal end portion 2A. Typically, the total length of cantilever tube 2A is approximately four and one-half feet. The wall thickness of distal end portion 2A is three millimeters, and the wall thickness of proximal end portion 2B is six millimeters. The inside and outside diameters of distal end portion 2A are 120 millimeters and 126 millimeters, respectively, and the inside and outside diameters of proximal end portion 2B are typically 120 millimeters and 132 millimeters respectively.

Figures 3, 3A:
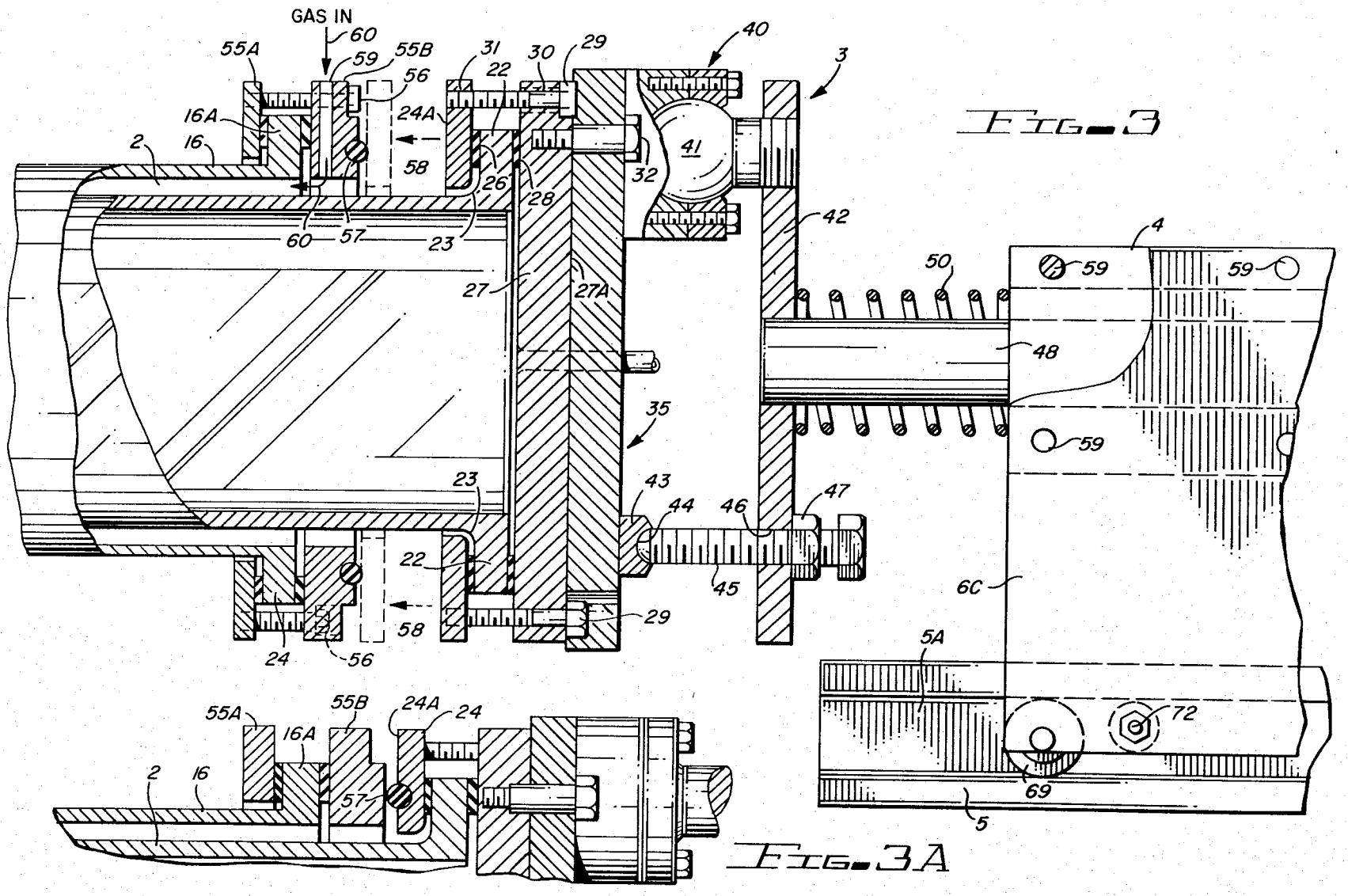
FIG. 3 is a partial cutaway section view taken along section line 3—3 of FIG. 1.
FIG. 3A is a partial section view showing an alternate flange sealing arrangement to that shown in FIG. 3.

As best seen in FIG. 3, cantilever tube 2 has a quartz annular flange 22 attached to its extreme proximal end. In accordance with good quartz manufacture procedures, radii 23 of 5 millimeters are provided between the forward face of flange 22 and the outer surface of cantilever tube 2. Also in accordance with good quartz manufacture procedures, flange 22 and the first several inches of cantilever tube 2 to the left of flange 22 are machined from a quartz block and the remainder of proximal end portion 2B is welded thereto. This produces a substantially stronger flange connection than the alternate expedient of welding a preformed flange 22 to the end of the cantilever tube.

As is well known in the art, diffusion tube 16 has a quartz flange 16A attached to its proximal or mouth end.

Figure 4B:
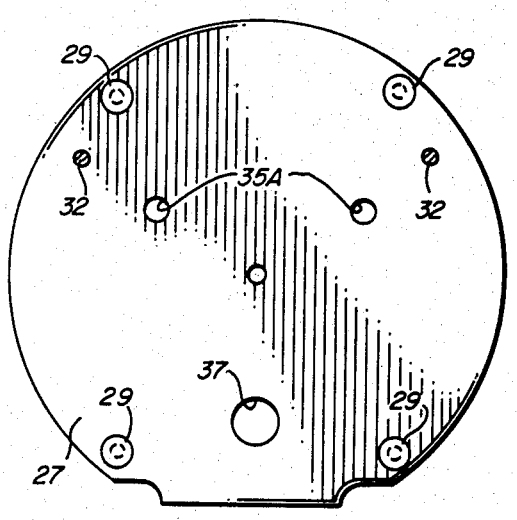
FIG. 4B is a section view taken along section line 4B—4B of FIG. 1.
Figure 4C:
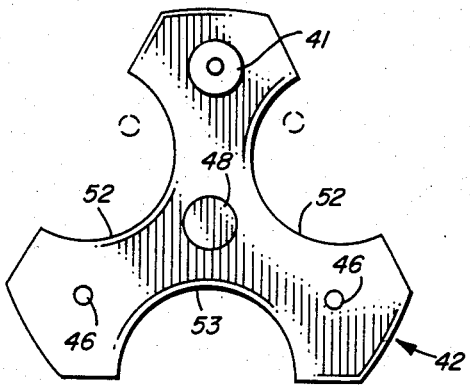
FIG. 4C is a section view taken along section line 4C—4C of FIG. 1.

Clamping mechanism 3 includes an annular clamp ring 24 which fits around cantilever tube 2 on the inner side of flange 22. A suitable gasket 26 is disposed between the inner face of clamp ring 24 and the adjacent face of quartz flange 22 to function as a seal between the two. Preferably, clamp ring 24 is formed of stainless steel. On the outer face of flange 22, a "door" plate 27, also preferably formed of stainless steel, seals the mouth of cantilever tube 2 and the mouth of diffusion tube 16. An annular fiber gasket 28 effectuates the sealing of flange 22 to door plate 27. Alternatively, and perhaps preferably, silicone filled fiber gaskets can be used. Door plate 27 is firmly clamped to clamp ring 24 by means of four socket head cap screws 29 positioned as shown in FIGS. 3 and 4B. The cap screws 29 extend through clearance holes such as 30 in door plate 27 and into threaded holes 31 in clamp ring 24, as best seen in FIG. 4A.

Two socket head shoulder screws 32 are screwed into threaded holes in the outer surface 27A of door plate 27, as best seen in FIGS. 3 and 4B. These shoulder screws 32 fit precisely into two vertical slots 34A and 34B in a support plate 35 (see FIGS. 3 and 4D). It can be seen that this arrangement allows the clamping ring 24 and door plate 27 to be pre-installed on flange 22 of diffusion tube 2. The cantilever tube 2 then can be quickly mounted on clamping mechanism 3 by simply carefully lowering cantilever tube 2 so that shoulder screws 32 slide into slots 34A and 34B of support plate 35.

Referring to FIGS. 1, 3, and 4B, door plate 27 has two symmetrically positioned holes 35A through which two gas flow tubes 36 (FIG. 1) extend to effectuate flow of reactant gases and purging gases in cantilever tube 2. Door plate 27 also has an opening 27 into which an "ultra-torr fitting" for receiving a thermocouple is disposed, as shown in FIG. 4B. This is necessary to allow temperature profiling of the inside of cantilever tube 2, with a partial vacuum maintained therein, when it is disposed inside diffusion tube 16 as shown in FIG. 2B.

Figure 4D:
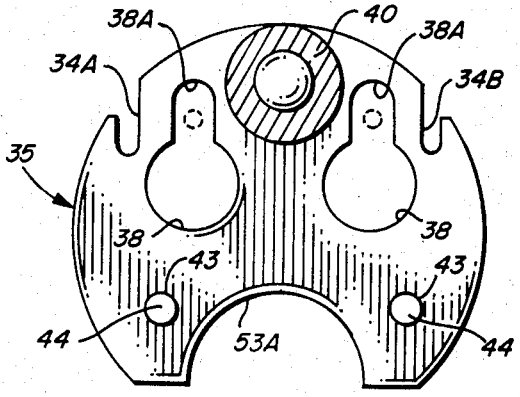
FIG. 4D is a section view taken along section line 4D—4D of FIG. 1.

Referring now to FIG. 4D, support plate 35 has two openings 38 therein, each of which has an elongated upper portion 38A. The two gas tubes 36 extend through the lower enlarged portions of openings 38 when the cantilever tube 2 with clamp rings 24 and door plate 27 clamped thereto has shoulder screws 32 which rest in vertical slots 34A and 34B so that the cantilever tube 2 is supported in cantilever fashion by clamp mechanism 3.

In order to remove a cantilever tube 2 which has been "contaminated" by numerous (typically 10 to 15) wafer processing runs, it and its door plate 27 are lifted to slide shoulder screws 32 out of vertical slots 34A and 34B. This, of course, also raises gas tubes 36, so the purpose of elongated upper portions 38A of openings 38 (FIG. 4D) in support plate 5 is to provide clearance for gas tubes 36 during this lifting process. As soon as the shoulder screws 32 clear slots 34A and 34B, the ends of gas tubes 36 are then pulled out of openings 38. Removal of the contaminated cantilever tube 2 then is complete. A clean cantilever tube 2 with its door plate 27 clamped thereto, can be quickly mounted on clamp mechanism 3 in a manner similar to, but reverse order to, the manner of removing the contaminated cantilever tube.

A socket 40 is attached to the upper portion of support plate 35 for receiving a ball 41, as best shown in FIG. 3. Ball 41 is attached to the upper portion of back plate 42. Back plate 42 is shown in plan view in in FIG. 4C.

Two rigid posts 43 are symmetrically positioned on opposite sides of the lower portion of support plate 35 (FIG. 3). Each of posts 43 has a semispherical, concave, outer end surface 44, as best shown in FIG. 3, for receiving the semispherical concave outer end of a threaded thrust bolt 45. The threads of two thrust bolts 45 each engage a respective threaded hole 46 in the lower outer opposed portions of back plate 42. Thus, it can be seen that back plate 42 provides a three point adjustable pivot system by means of which the "aim" or direction of support plate 35 can be precisely adjusted by rotating the two thrust bolts 45. Jam nuts such as 46 securely lock the position or attitude of support plate 35 once the proper adjustment aligning the cylindrical axis of cantilever tube 2 with the cylindrical axis of diffusion tube 16 has been accomplished.

Preferably, support plate 35 and back plate 42 are formed of stainless steel material that is approximately one half inch thick. A one inch diameter stainless steel precision rod 48 is attached to the center portion of back plate 42 and is perpendicular to the plane thereof. Rod 48 slides precisely in and out of a conventional linear bearing 4, such as a Thompson bearing, which is available from Linear Industries, Inc. The length of shaft 48 is 11 inches. At the opposite end of rod 48 is a rectangular stop 49 (FIG. 1) that prevents rod 48 from being pulled through Thompson bearing 4 and prevents rotation of the clamp assembly 3. Two springs 50 and 51 are disposed on the opposite ends of rod 48. The forward spring 50 applies an appropriate amount of pressure urging clamp ring 24 against either flange 16A of diffusion tube 16, or a stainless steel clamp attached thereto, in order to effect sealing of cantilever tube 2 with respect to diffusion tube 16 when the former has been inserted all the way into the latter. The rear spring 51 performs the function of absorbing shock that may result from a sudden release of vacuum as motorized driver 14 (FIG. 1) draws carriage 6 rearward in the direction of arrow 9.

At this point, it might be well to note that the cut-outs 52 in back plate 42 are for the purpose of accommodating gas tubes 36, as best seen in FIG. 1. The purpose of cut out 53 is to accommodate a thermocouple support passing through the ultra-torr fitting (not shown) that is disposed in hole 37 of door plate 27. Cut out 53A of support 35 also accommodates the thermocouple support.

Now that the details of one embodiment of cantilever tube 2 and clamping mechanism 3 have been described, the details of sealing clamping ring 24 to the flange 16A of diffusion tube 16 will be described with reference to FIGS. 3 and 3A. Referring first to FIG. 3, in some instances a pair of stainless steel clamp rings 55A and 55B are clamped to opposite faces of flange 16A by means of a pair of socket head cap screws 56. A silicone O-ring 57 is disposed in a groove in clamp ring 55B and forms a seal with the face 24A of clamp ring 24 as clamp mechanism 3 and cantilever tube 2 move in the direction of arrows 58. Alternatively, O-ring 57 could be disposed in a suitable annular groove in face 24A. One advantage of using the clamp rings 55A and 55B is that a gas radial inlet opening 59 can be provided in a convenient portion of clamp ring 55B, allowing gas to be inlet or exhausted from hole 59 into the region between diffusion tube 16 and cantilever tube 2, as indicated by arrows 60.

Referring now to FIG. 3A an alternate seal arrangement is shown wherein the O-ring 57 is incorporated in an annular groove in face 24A of clamp ring 24 and forms a sealing relationship with clamp ring 55B. In the structure of FIG. 3A, clamp rings 55A and 55B can be omitted if desired, and O-ring 57 can form a seal directly with diffusion tube flange 16A.

Figure 5:
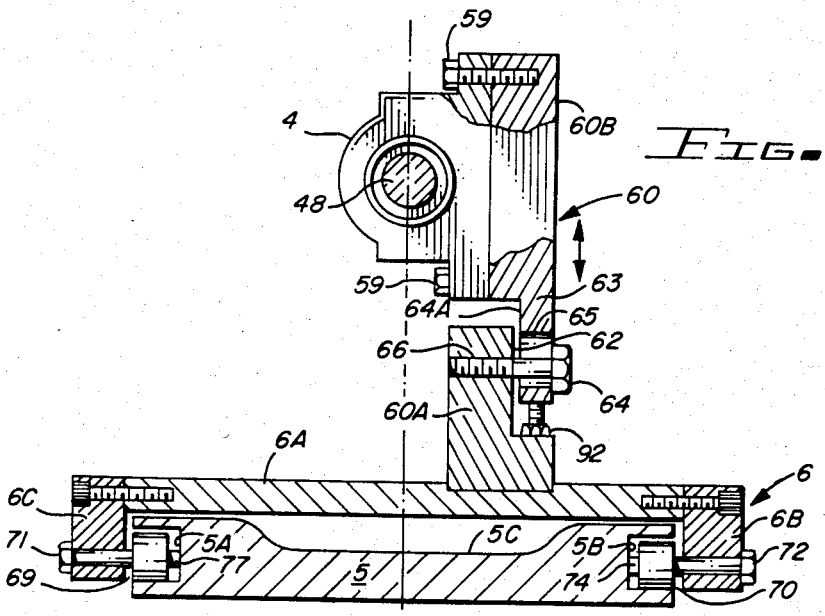
FIG. 5 is a section view taken along section line 5—5 of FIG. 1.

Next, the details of carriage 6 and linear track 5 will be described, mainly with reference to FIGS. 1, 1A, 3, and 5. Referring now to these figures, Thompson bearing 4 is bolted by means of a plurality of bolts 59 to a vertically adjustable member 60. (See FIG. 5.) Vertically adjustable member 60 has a lower portion 60A that is rigidly attached to horizontal top plate 6A of carriage 6. Top plate 6A is rigidly supported between two side plates 6B and 6C, which support wheels or rollers 79, 70 that move in grooves 5A and 5B of track 5, respectively. As best seen in FIG. 5, lower member 60A of vertically adjustable member 60 has an L-shaped cross section with a vertical smooth flat face 62. Upper section 60B has a half-thickness lower portion 63 with a vertical flat face 64A that slides against face 62. A shoulder screw 64 extends through an elongated clearance hole 65 in portion 63 and has threaded hole 66 in lower member 60A. There are a plurality of such shoulder screws 64 in a corresponding plurality of elongated slots 65 disposed in vertically adjustable member 60 to allow vertical adjustment of the upper portion of member 60 during initial coaxial alignment of cantilever tube 2 with diffusion tube 16. Jack screws 92 thread into the lower surface of member 60 for facilitating vertical adjustment of upper section 60B. The heads of jack screws 92 bear on a horizontal surface of member 60A. Shoulder screws 64 are tightened once proper vertical adjustment has been attained.

Linear track 5 has a recess 5C in its upper surface as shown in FIG. 5. The lower "tabs" on clamp ring 24 and door plate 27 (FIGS. 4A and 4B) extend, with considerable lateral and vertical clearance, into recess 5C so as to provide maximum structural strength for clamp ring 24 and door plate 27 and yet allow a good degree of vertical and lateral adjustment of clamp mechanism 3 relative to track 5.

On the forward or left end of carriage 6 as shown in FIG. 1, precision bearing wheels 69 and 70 are mounted by means of axles 71 and 72 onto the lower inside ends of side plates 6C and 6B, respectively. Bearing wheels 69 and 70 extend into precision track grooves 5A and 5B of track 5 with clearance of only approximately 5 mils (thousandth of an inch) to avoid vertical movement of any portion of carriage 6 as it moves along track 5.

At the rear or right hand end of carriage 6, a rear wheel support portion generally designated by reference numeral 75 is pivotally connected, as schematically indicated by reference numeral 76 in FIG. 1A, to the forward portion of carriage 6. Rear portion 75 also has two side plates analogous to side plates 6A and 6B for supporting two precision rear bearing wheels similar to 69 and 70. The purpose of the swivel connection 76 is to avoid "binding" of carriage 6 due to any slight "twist" or warpage that may exist in track 5, and thereby allow free forward and rearward movement of carriage 6 by motorized drive mechanism 14 (FIG. 1) without binding.

In order to keep carriage 6 precisely centered on track 5, four adjustable Teflon slide bearings such as 77 and 78 in FIG. 5 are mounted inwardly of bearing wheels such as 69 and 70 on the side walls 6C and 6B of carriage 6 and also inwardly of the rear bearing wheels on the side walls of the pivotal rear portion 75 of carriage 76. FIG. 1B shows Teflon bearing 78 attached to the end of an adjustment screw 79 that extends through a threaded hole 80 in side plate 6B of carriage 6. A jam nut 81 locks the adjustment. The four Teflon bearings allow precise lateral adjustment of the orientation of carriage 6 relative to track 5 and also prevent lateral movement of carriage 6 as it moves along track 5.

Figure 7:
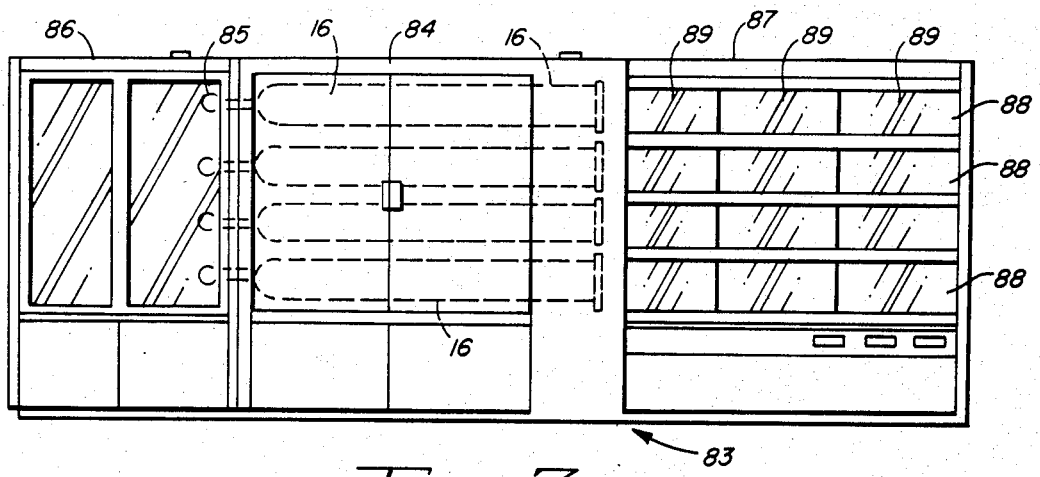
FIG. 7 is an elevation view of a typical diffusion station in which the apparatus of the present invention can be installed.

Before describing the operation of the cantilever diffusion tube system 1 and the advantages thereof, it may be helpful to more fully understand the furnace station in which the diffusion tubes 16 are disposed. Referring to FIG. 7, a typical diffusion furnace "station" 83 is shown. It contains three sections, including a generally centered furnace section 84 in which 4 diffusion tubes 16 are disposed in a well known fashion. The opening in the left hand end of each diffusion tube 16 is narrowed to form a "pigtail" 85 which extends into a "source cabinet" 86. Inside source cabinet 86 are connections to various reactant gases and purging gases that are needed to carry out the desired wafer processes. At the opposite end of the "stack" or furnace 84 is similar "stack" 87 of four loading stations 88. Each of the four loading stations is rectangular and closed on all sides except for the front side shown in FIG. 7. Three sliding doors 89 can be opened to allow access to each loading station 88. The bottom of each loading station 88 has a solid shelf to which linear rail or track 5 of the described cantilever diffusion system is attached. Thus, when the cantilever tube 2 is in its retracted or withdrawn position as shown in FIG. 2A, both the cantilever tube 2 and the entire cantilever support mechanism including clamp 3 and carriage 6 and track 5 are all disposed in one of loading stations 88, from which the cantilever tube 2 can be moved into the mouth of the adjacent diffusion tube 16. Typically, in a modern semiconductor wafer fabrication facility two stations such as 83 are positioned back to back in order to save costly floor space.

The particular cantilever tube 2 shown in FIGS. 1, 2A, and 2B described above is particularly well suited to low pressure chemical vapor deposition (LPCVD) processes, which are typically carried out at much lower temperature, for example, 400–800 degrees centigrade, then thermal oxidation or semiconductor diffusion processes, which are typically carried out at temperatures of roughly 850 degrees centigrade to 1150 degrees centigrade. For an LPCVD process, it appears that the open end of the distal end portion 2A of cantilever tube 2 is desirable, although in other processes, such as thermal oxidation, it may be desirable to have a much smaller opening, for example, 30 millimeters in diameter, at the distal end of the cantilever tube 2.

The basic operation, however, is common to all embodiments of cantilever tube 2, and includes first loading the wafer carrying quartz boats (which are commonly called diffusion boats regardless of whether they are used for diffusion or oxidation, etc.) through window 19 into the distal end portion of cantilever tube 2, as shown in FIG. 2A. Typically, four to six boats each containing typically 50 to 75 five or six inch wafers can be loaded into cantilever tube 2. Access to window 19 is attained by opening one of the sliding glass windows 89 in loading station 87 (FIG. 7). Next, quartz cover 20 is positioned to cover window 19. The inert gas, typically nitrogen, is fed through gas tubes 36 (typically at 100 to 8000 standard cubic centimeters per minute) and caused to flow through cantilever tube 2 and provides an inert initial atmosphere for the wafers 11. Motorized drive mechanism 14 is actuated and begins to slowly advance carriage 6 and cantilever tube 2 supported thereby toward and into diffusion tube 16.

It is being assumed that track 5, carriage 6, and clamping mechanism 2 have all been aligned, so that cantilever tube 2 is precisely coaxially aligned with diffusion tube 16. To explain one way of easily accomplishing such alignment, it may be helpful to digress for a moment and refer to FIG. 2A to explain how this "one time" alignment step is performed. A laser 90 produces a beam 91 that is aimed through the pigtail opening 85 at the left end of the diffusion tube 16. A plexiglass plate (not shown) with a perfectly centered small hole in it is attached to flange 24 at the mouth of diffusion tube 16. The laser is oriented so that the laser beam 91 passes through that hole. At this point, the laser 90 is properly oriented. A door plate such as 27 is then attached to support plate 35 of clamping mechanism 3. The plate will have a perfectly centered mark on it, which may be a machining mark that is produced when support plate 35 is manufactured. With carriage 6 at its most forward position, as shown in FIG. 2B, the lateral position of rail 5 is adjusted and secured, and the front jack screw such as 92 in FIG. 5 is turned to adjust the elevation of clamp mechanism 3 so that the laser beam 91 strikes the center mark of door plate 35. An identical jack screw on the back end of vertically adjustable member 60 is used to adjust the elevation of the back portion of member 60. Shaft 48 can be slid in and out of Thompson bearing 4 to ensure that rod 48 is properly aligned with laser beam 91. Carriage 6 then is moved to its rear position, as shown in FIG. 2A, to determine if the laser beam 91 still strikes the center mark of door plate 27. If it does, the alignment is complete, but if not, the lateral and vertical positions of the rear portion of rail 5 must be shimmed or otherwise adjusted until laser beam 91 strikes the center mark of door plate 27 during the entire travel of carriage 6 along rail 5. Finally, a door plate 27 is clamped, as previously described, to a cantilever tube 2 which then is mounted on support plate 35 of clamping mechanism 3. The orientation of that cantilever tube 2 is adjusted by turning thrust bolts 45 (FIG. 3) so that the distal end of cantilever tube 2 is concentrically aligned with the mouth of diffusion tube 16.

Returning now to the description of the operation of the cantilever tube system, motorized drive system 14 continues the slow advancing of cantilever tube 2 into diffusion tube 16 until clamp ring 24 or O-ring 57 (see FIGS. 1, 3, 3A) engages either the clamp ring attached to flange 16A of diffusion tube 16 or flange 16A itself, depending upon which sealing scheme is used.

Spring 50 is compressed as carriage 6 continues to move forward until an adequate pressure is applied to accomplish reliable sealing of cantilever tube 2 to the flange 16A of diffusion tube 16. At this point, the reactant gases can be allowed to flow through cantilever tube 2 and replace the inert gas, as soon as the wafers, which are now in the hot zone of the furnace tube 16, have been elevated to the desired temperature. (It should be appreciated that the term "inert gas" as used herein is not strictly correct, as nitrogen is what is typically used. The word "inert" means that the gas does not cause any significant physical or chemical change in the wafers 11.) After a suitable amount of time elapses, the reactant gases are purged by means of inert purging gas (typically nitrogen at a flow rate of roughly 100 to 8000 standard cubic centimeters per minute), a motorized drive mechanism 14 is actuated to gradually begin withdrawal or "pulling" of carriage 16 back to its initial position. As the "pulling" operation continues, the purging gas continues to flow through the inlet tubes 36, and the wafers 11 inside cantilever tube 2 move along with the surrounding atmosphere during the entire pulling operation, thereby avoiding the cold "blast" of atmospheric air encountered during withdrawal using conventional cantilever loading systems. With relatively small amounts of nitrogen purging gas, the pulling rate can be substantially greater (roughly 9 inches per minute) than for previous cantilever systems without the danger of the wafers being prematurely exposed to atmospheric oxygen, which causes "$Q_{SS}$ shift", before the wafers reach a satisfactory load temperature, typically under 600° C.

Since the wafers are fairly precisely centered in cantilever tube 2 during the diffusion operation, and since the boats, such as the ones shown in FIG. 9, do not have high thermal mass, as do the alumina rods of some previous cantilever systems, the temperature gradient across the diameter of cantilever tube 2 during the LPCVD process (or any other process) is quite uniform. The flow of gas in cantilever tube 2 is also quite uniform, and cooling of the wafers therein is quite uniform across their diameters during withdrawal. This uniformity, as well as the avoidance of air containing defect-causing particulates, is achieved by keeping wafers 11 inside the cantilever tube 2 during withdrawal and by providing a continual flow of purging gas which allows rapid withdrawal of wafers without risk of wafer warpage and associated problems. The described structure avoids the usual transferring of wafers into the non-laminar flow situation that usually exists in a conventional loading station at the front end of a diffusion tube.

When motorized drive system 14 is initially actuated at the end of the diffusion or deposition cycle, spring 51 (FIG. 1) is initially compressed as carriage 6 moves rearward in order to effectuate breaking of a vacuum seal that typically would exist in tube 16 so that end cap 49 of shaft 48 does not suddenly strike the rear end of Thompson bearing 4.

After the wafers 11 have cooled sufficiently in the loading station, quartz cover 20 is removed from window 19 and the tines of fork 12A of FIG. 9 are inserted into the receiving holes 12B of the quartz boats 12 which, one by one, are quickly removed from cantilever tube 2 and out of the non-laminar air flow environment in the loading station, and are moved to a region wherein an ultrapure, laminar air flow, particulate-free environment presumably exists.

Ordinarily, the nitrogen purging gas would continue to flow to prevent any particulate-containing air from flowing into cantilever tube 2 through open window 19. The next load of wafer carrying boats is placed in cantilever tube 2 through window 19, quartz cover 29 is replaced and the above-described cycle is repeated.

Since the reactant gases flow mainly through cantilever tube 2 (although a certain amount of "back-streaming" into the region between cantilever tube 2 and diffusion tube 16 may occur), very little silicon nitride or polycrystalline silicon or any other substance from the reactant gases is deposited inside diffusion tube 16. Therefore, the diffusion tube 16 rarely, if ever, has to be cleaned if the above described cantilever tube system is used, so the necessity of ramping down the temperature of the diffusion tube furnace to allow cleaning of diffusion tube 16 and then ramping the temperature back up (and the many hours of time that are usually required for such temperature ramping) are avoided because when the interior of cantilever tube 2 becomes sufficiently contaminated, it can be removed and replaced by a clean cantilever tube 2 in only a few minutes. As previously explained, this is done by simply first disconnecting the flexible gas feed lines (not shown) from the connectors shown at the ends of gas tubes 36 in FIG. 2. Then, after the cantilever tube 2 has cooled enough to where it can be safely handled, it is simply lifted so that the shoulder screws 32 (FIG. 3) slide out of the vertical slots 34A and 34B (FIG. 4D) and the gas tubes 36 are guided out of openings 38 (FIG. 4D). This assembly is set aside and replaced by an identical but clean one, by simply carrying out the same steps but in reverse order. Wafer carrying quartz boats are then loaded into cantilever tube 2, as described previously, and within only a few minutes, the previously described cycle is repeated. Thus, there has been much reduced diffusion furnace "down time" compared to when previous loading systems, including cantilever loading systems, are used.

Next, referring FIGS. 6A and 6B an alternate structure for the proximal end of cantilever tube 2 is disclosed. As before, clamping flange 22 is attached to the mouth of cantilever tube 2. However, for high temperature semiconductor diffusion and thermal oxidation steps, it may be desirable to isolate clamping mechanism 3 from the higher temperatures (i.e., higher temperatures than for LPCVD processes) that the cantilever tube 2 encounters. This isolation reduces or prevents oxidation and/or warpage of its metal door plate 27. To accomplish this isolation, a second sealing flange 94 spaced by an appropriate amount, for example, nine inches, from clamping flange 22 is provided. Quartz sealing flange 94 (FIG. 6B) is the flange that then engages the flange 16A of quartz tube 16 (FIG. 3), instead of clamping flange 22 thereof. Sealing flange 94 can directly engage a stainless steel clamping ring such as 55B (FIG. 3) of quartz tube flange 16 or, alternatively, a stainless steel dual annular sealing ring arrangement of the type shown in FIG. 6B can be clamped to sealing flange 94. In FIG. 6B, two stainless steel annular rings 95 and 96 are clamped onto the opposed faces of sealing ring 94. It will be appreciated that the clamp ring 96 needs to be of the "split" variety, since it will not slip over either quartz flange 94 or quartz flange 22. As before, suitable cap screws and sealing gaskets can be used. Then, if ring 95 is to produce a seal with respect to quartz flange 24 of diffusion tube 16, then an O-ring 97 must be embedded in a groove in stainless steel ring 95.

Returning now to FIG. 6A, which shows a partial cutaway top view of cantilever tube 2 as it is positioned on clamping mechanism 3 by means of clamp flange 22 in the manner previously described, a small-diameter quartz tube 99 extends horizontally from one side to the opposite side of cantilever tube 2, allowing cold gas to flow in the direction of arrow 100 for the purpose of causing condensation of $POCl_3$, which is commonly used as a reactant in diffusion operations. Tube 99 is attached at 101 to the inner wall of cantilever tube 2. The opposite end of condensation tube 99 simply extends to or beyond the opposite side of cantilever tube 2, but is not connected to the opposite side. Instead, a second half-length quartz tube 103 is attached to the side of quartz tube 2 at 104. The annular region between tubes 99 and 103 functions as an exhaust for $POCl_3$ gas flowing in the direction of arrow 105 within cantilever tube 2. This gas passes between tubes 99 and 103 and is rapidly cooled before some of it is exhausted in the direction of arrows 105.

The condensed phosphorous then runs off the inner edge of tube 103 and drips into a small drip dish 106. This expedient helps to avoid liquid phosphorous contamination inside diffusion cantilever tube 2.

Referring now to FIG. 6C, another alternative structure for the proximal end of cantilever tube 2 is shown. Again, a sealing flange 94, as previously described, is provided to accomplish thermal isolation of clamping flange 22 from the hotter parts of the diffusion tube. In this case, an internal bypass tube 107 is provided to allow gas to be exhausted from the region between cantilever tube 2 and diffusion tube 16 in the direction indicated by arrows 108.

In some instances it may be desirable to use a dashpot or damper (not shown) that is attached in fixed relationship to carriage 6 and has its piston connected to the rear end of rod 48 in order to prevent oscillation of the rod 48 and the clamping mechanism 3.

Figure 8:
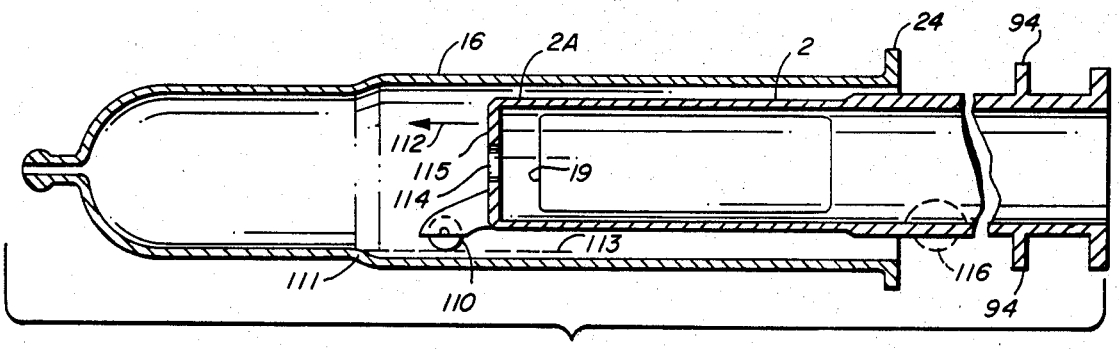
FIG. 8 is a schematic section diagram illustrating an alternate embodiment of the present invention.

Referring now to FIG. 8, another variation on the cantilever tube of the present invention is shown. Here, a front quartz wheel assembly 110 is attached to the leading or distal portion of cantilever tube 2. In this example, diffusion tube 16 has a slightly reduced inside diameter on a step at the portion on which front wheel 110 rests when sealing flange 94 ultimately comes to rest in sealing relationship with flange 24 of diffusion tube 16. Thus, there is a slight step 111 on the inner bottom surface of diffusion tube 16. During insertion of cantilever tube 2 (as indicated by arrow 112) into diffusion tube 16, quartz wheel 110 is actually supported above the bottom of diffusion tube 16. The bottom of wheel 110 moves along dotted line 113 until step 111 is encountered. Thus, once cantilever tube 2 is in its final position inside diffusion tube 16, the distal end portion 2A thereof is supported by quartz wheel 110. Although this arrangement does result in a small amount of quartz-to-quartz abrasion, it occurs only for the last inch or so of travel of cantilever tube 2. The production of any quartz particulates by such abrasion is negligible and any particulates produced are outside of cantilever tube 2. Furthermore, in some cases, the end portion 114 of cantilever tube 2 will have a relatively small hole 115 therein, as in oxidation processes, and ordinarily, the higher gas pressure inside cantilever tube 2 relative to the gas pressure in diffusion tube 16 would prevent any particulate from entering cantilever tube 2 and coming into contact with any of the wafers inside cantilever tube 2.

In some cases, it will be advantageous to provide a second wheel indicated by dotted line 116 which supports a mid-portion of cantilever tube 2. Again, more quartz-to-quartz abrasion will be produced, but it will all be outside of cantilever tube 2 wherein the wafers under process are disposed. The two foregoing quartz wheel structures will be advantageous if the cantilever tube 2 is exposed to temperatures in excess of 1100° C. for extended periods of time and will prevent sagging of cantilever tube 2 by greatly relieving the stresses on it.

Under circumstances in which the quartz-to-quartz abrasion is kept entirely outside of tube 2, it will in some instances be practical to simply provide quartz wheels such as 110 and 116 as the only support for a tube carrying therein the wafers to be processed. A clamping ring such as 24 and a door plate such as 27 and gas inlet tube such as 36 would still be required, but it would not be necessary to support the tube in a cantilever fashion.

The above described embodiments of the invention have been found to overcome most of the previously mentioned shortcomings of prior art cantilever loading systems and the shortcomings of prior art loading systems in general. To summarize these advantages, first, the atmosphere surrounding the wafers during withdrawal from the diffusion furnace moves along with the wafers during withdrawal from the furnace, avoiding excessive thermal shock while allowing relatively rapid withdrawal rates. Far less nitrogen purging gas is required during withdrawal to isolate the wafers from atmospheric oxygen before the wafer temperatures have fallen to adequately low levels, usually below 600° C., to avoid $Q_{SS}$ shifts. While the wafers are cooling in the loading station, they are isolated from particulates in the nonlaminar air flow that usually exists in diffusion furnace loading stations. Another important advantage of the foregoing apparatus and method is that nearly all of the contamination of the diffusion tube that usually occurs is now confined to within the cantilever tube 2, since the reactant gases are mainly confined to within the cantilever tube. This means that the diffusion tube needs to be rarely, if ever, cleaned and consequently, the costly and time consuming operations of ramping the furnace temperature up and down and the labor associated with cleaning the diffusion tube in situ or removing it and cleaning it elsewhere are avoided. The necessity of ramping the furnace temperature downward somewhat to accomplish effective withdrawal for some prior cantilever systems is avoided, and the time delay associated therewith is reduced. The problems associated with the high thermal mass of the alumina rods of prior cantilever systems are avoided. More specifically, larger wafers can be processed with already available diffusion tubes because the space required by the quartz rods of previous cantilever systems is available for semiconductor wafers and boats. The non-uniform gas flow caused by the presence of the large rods of prior cantilever systems in the paths of gas flow are avoided, as is the high thermal mass and non-uniform temperature variations and resulting processing variations caused by some present cantilever loading systems so that uniform processing is achieved across each wafer. For example, in LPCVD nitride deposition, nitride oxide thickness variations across the wafers of only 20 angstroms per thousand have been achieved compared to 50 angstroms per thousand for the above prior art cantilever loading systems. With the cantilever tube system of the present invention, ordinarily the semiconductor wafers are nearly concentrically positioned in the diffusion furnace. This is known to be optimum or nearly so for much wafer processing in diffusion tubes. Various conditions, such as presence of haze and streaking that have been associated with formation of ammonium chloride on wafers during withdrawal from prior systems are avoided. Possible problems associated with diffusion of metallic impurities from the alumina or metal support rods in prior cantilever systems are avoided. The high cost of nitrogen gas consumed by purging during withdrawal of prior cantilever systems is avoided. Significant amounts of reactant gases are saved also. The substantial amount of labor and time delay associated with removal and cleaning of prior cantilevers, either in situ or otherwise, is avoided. Oscillations that are known to occur in some prior art rod-type cantilever systems are avoided by applicant's configuration. The much greater structural strength of the described cantilever tube system allows much larger wafer batches to be processed in a single run through the diffusion tube. In short, the described invention is believed to be a "break-through" in wafer fabrication processes involving operations in diffusion tubes.

Figure 10:
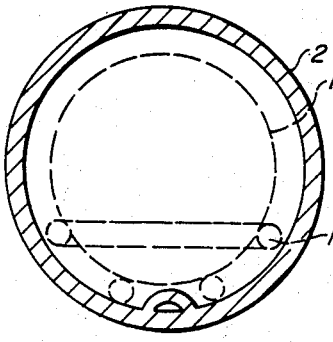
FIG. 10 is a section view illustrating a manifold gas distribution system that can be used in the cantilever tube of FIG. 1.

While the apparatus and method of the present invention have been described with reference to several particular embodiments thereof, those skilled in the art will be able to make various modifications to the described structure and method without departing from the true spirit and scope of the invention. However, it is intended that variations of the described apparatus and method that are equivalent to those described herein, in that they accomplish substantially the same function in substantially the same way to obtain substantially the same result, are within the scope of the invention. For example, various other carriage mechanisms and clamping mechanisms could be provided to accomplish described operation and achieve the benefits thereof. The quartz parts can be made of silicon carbide, polycrystalline silicon, or other suitable material. The stainless steel parts could be made of other materials. For example, the door plate 27 could be made of quartz and be integral with cantilever tube 2, especially if especially corrosive reactant gas, at very high temperatures, is used. As shown in FIG. 10, a manifold tube 130 can be formed in the bottom of cantilever tube 2 with a plurality of spaced upper outlet holes 131 provided to effectuate uniform distribution of reactant gas directly into the hot zone when the wafers are positioned.

I claim:

1. A method of processing a plurality of semiconductor wafers in a furnace, said method comprising the steps of:

(a) holding a rigid, heat-resistant first tube having a first end and a second end in a cantilever manner by said first end thereof;

(b) placing said plurality of wafers in spaced relationship to each other inside said first tube;

(c) causing a first gas to flow into said first tube between said wafers and out of said first tube;

(d) moving said first tube with said wafers therein into a rigid, heat-resistant second tube that is located in said furnace to position said plurality of wafers in a hot zone of said furnace while said first gas is flowing between said wafers;

(e) stopping the flow of said first gas into said first tube;

(f) causing a reactant gas to flow into said first tube, between said wafers in said hot zone, and out of said first tube;

(g) stopping the flow of said reactant gas into said first tube after the elapsing of a predetermined amount of time;

(h) causing a second gas to flow into said first tube, between said plurality of wafers, and out of said first tube;

(i) moving said first tube and said wafers therein out of said second tube while continuing said flow of said second gas; and (j) removing said plurality of wafers from said first tube.

2. The method of claim 1 including allowing the temperature of said wafers to stabilize in said hot zone before step (e).

3. The method of claim 1 wherein said first tube has an annular flange attached to the first end thereof and said holding step includes clamping said annular flange toward a support plate to effectuate holding of the entire weight of said first tube and said wafers therein by means of said annular flange during steps (d) and (b).

4. The method of claim 1 wherein said first tube has a window opening in a distal end portion thereof, said method including a cover over said window opening after step (b) but before step (d).

5. The method of claim 3 including sealing said annular flange with respect to an annular flange attached to a first end of said second tube during a final portion of step (d).

6. The method of claim 3 wherein step (d) is performed by means of a motorized mechanism coupled to a carriage supporting the means clamping said annular flange of said first tube.

7. The method of claim 5 wherein the reactant gas flows into said first tube through an opening in a cover plate clamped to said first end of said first tube, and flows out of an opening in the second end of said first tube and into said second tube.

8. The method of claim 5 wherein the reactant gas flows into an opening at a pigtail end of said second tube and into said second tube and then into an opening at the second end of said first tube and out of said first tube through an opening in said first end of said first tube.

9. The method of claim 3 including engaging said annular flange by means of a clamping mechanism attached to a carriage which moves on a track.

10. The method of claim 1 wherein both said first gas and said second gas are nitrogen.

11. The method of claim 1 wherein said moving of step (i) is approximately 9 inches per minute.

12. The method of claim 1 wherein said first tube is composed of material of one of the group consisting of quartz, silicon carbide, and polycrystalline silicon.

13. The method of claim 10 wherein the flow rate of said second gas through said first tube is approximately 100 cubic centimeters per minute.

14. A method of processing a plurality of semiconductor wafers in a furnace, said method comprising the steps of:

(a) holding a rigid, heat-resistant tube having a first end and a second end in a cantilever manner by said first end thereof;

(b) placing said plurality of wafers in spaced relationship to each other inside said tube;

(c) causing a first gas to flow into said tube between said wafers and out of said tube;

(d) moving said tube with said wafers therein into said furnace to position said plurality of wafers in a hot zone of said furnace;

(e) stopping the flow of said first gas into said tube;

(f) causing a reactant gas to flow into said tube, between said wafers in said hot zone, and out of said tube;

(g) stopping the flow of said reactant gas into said tube after the elapsing of a predetermined amount of time;

(h) causing a second gas to flow into said tube, between said plurality of wafers, and out of said tube;

(i) moving said tube and said wafers therein out of said hot zone of said furnace while continuing said flow of said second gas; and (j) removing said plurality of wafers from said tube.

* * * * *